US006311510B1

(12) United States Patent
Sunama et al.

(10) Patent No.: US 6,311,510 B1
(45) Date of Patent: Nov. 6, 2001

(54) VAPOR CONDENSER WITH HIGH EFFICIENCY FOR USE IN VACUUM APPARATUS

(75) Inventors: Ryouji Sunama; Airu Yao, both of Saitama-ken (JP)

(73) Assignee: Kyowa Vacuum Engineering, Ltd., Tokyo (JP)

( * ) Notice: Subject to any disclaimer, the term of this patent is extended or adjusted under 35 U.S.C. 154(b) by 0 days.

(21) Appl. No.: 09/547,337

(22) Filed: Apr. 11, 2000

(30) Foreign Application Priority Data

Apr. 28, 1999 (JP) ..... 11-121478

(51) Int. Cl.[7] ..... F25B 19/00

(52) U.S. Cl. ..... 62/268; 62/434; 62/515; 165/168

(58) Field of Search ..... 165/168, 169, 165/164; 62/268, 434, 515

(56) References Cited

U.S. PATENT DOCUMENTS 2,828,533 * 4/1958 Fromson ..... 165/168
4,407,140 * 10/1983 Kobayashi ..... 62/268
4,602,674 * 7/1986 Eriksson ..... 165/168
5,667,168 * 9/1997 Fluegel ..... 165/169

* cited by examiner

*Primary Examiner*—Ronald Capossela
(74) *Attorney, Agent, or Firm*—Browdy and Neimark

(57) ABSTRACT

Refrigerant cooling coils inserted within a passage of brine in a heat exchanger are so deformed into a shape of flat elliptical cylinder that long axis of ellipse is parallel to a condensing surface, and a side or two sides of a pair of flat faces formed by deformation machining are fitted within the passage, closely contacted with an inner wall of the passage of the brine, in order to increase the contact surface between the refrigerant cooling ellipse coils and the inner wall of the passage of brine in the vapor trap plate and in order to enhance boundary film convection heat transfer coefficient of the brine circulated in the passage of said heat exchanger so as to provide excellent heat transfer property and great vapor condensing capability.

2 Claims, 3 Drawing Sheets

VAPOR CONDENSER WITH HIGH EFFICIENCY FOR USE IN VACUUM APPARATUS

BACKGROUND OF THE INVENTION

1. Field of the invention

This invention relates to a vapor condenser for use in a vacuum apparatus, and in particular, to some improvement of the vapor condenser especially developed by the present applicant before and mentioned in Japanese Patent Publication No. 58-12042 equivalent to U.S. Pat. No. 4,407,140 (hereinafter sometimes called the "prior invention").

2. Description of the Prior Art

A vapor condenser (hereinafter sometimes called the "trap") for use in a vacuum apparatus is widely used for the purpose of condensing and trapping the vapor of water and other solvent generated from the material to be treated within a vacuum chamber on a refrigerated surface. Thus, vacuum pressure in the vacuum chamber will be maintained at a desired value. This vapor condenser is constituting the essential part of the vacuum apparatus such as vacuum freeze drying apparatus, vacuum drying apparatus, vacuum concentration, vacuum distillation, vacuum cooling, desolvent or the like.

The trap in a vacuum apparatus, from the viewpoint of theory of heat transfer engineering, may be considered as a sort of heat exchanger between a low temperature medium (refrigerant, the first medium) and a high temperature medium (vacuum vapor, the second medium). And the refrigeration condensing vacuum vapor is provided from low tempeature of refrigerator unites. For the heat exchanger with form of heat transfer, heat flux is transferred through a boundary metal wall from high temperature fluid to low temperature medium. There are three types for the heat exchanger. The first, direct transfer type (heat is exchanging directly between the high and the low temperature medium), the second, indirect type (heat is exchanging indirectly by circulating a middle fluid between the high and the low temperature medium), and the third, triple heat exchanger type (three medium heat exchange).

Three types of the trap (vapor condenser) from FIG. 1 to FIG. 3 will be explained by means of each view illustrating roughly the vapor condenser for use in the vacuum freeze drying apparatus for medical products together with the basic construction of the apparatus as a whole.

FIG. 1 denotes a universally utilized standard type one in which a trap 101 is a refrigerant evaporator with the type of refrigerant direct cooling expansion. FIG. 2 shows a locally utilized type one where a trap 102 is of an "indirect brine type" which comprises a circulating brine having been cooled with a refrigerant by means of an outside heat exchanger 7. And, a trap 103 shown in FIG. 3 is of a "three medium heat exchange type" where both the refrigerant and the brine circulate inside thereof.

In FIGS. 1 to 3, each of the vacuum system is composed of a vacuum drying chamber 1 (which is also used as a freezing chamber), a vacuum trap chamber 2, a main connecting pipe 3*a*, a main valve 3, a vacuum exhausting system 4 and so on (including the profile of the chamber, machinery and piping). It is wholly indicated with a thin On the other hand, a freezing refrigerant circulating system including a refrigerator unit 11 (which includes all of a compressor, an oil separator, a condenser, an intermediate cooler used in the case of two-stage compressions, etc., and further includes the case of double freezing), a secondary refrigeration unit 12, a heat exchanger 7 for refrigerant evaporator 7*a*, a secondary heat exchanger 8 for refrigerant evaporator 8*a*, the trap 101 of refrigerant direct cooling type, the trap 103 of the prior invention (U.S. Pat. No. 4,407,140), each refrigerant evaporator, a refrigerant pipeline, a refrigerant valve 13, a refrigerant expansion valve 14 (indicated with a triangle mark), etc., is wholly indicated with a broken line.

The brine-system machinery including a shelf 5 (a plate which supplies a latent heat necessary for drying the material to be treated and supplies a cooling heat necessary for pre-freezing the material being treated in the instances of FIGS. 1 to 3), a brine heater 6, a brine system 7*b* of the heat exchanger 7, a brine system 8*b* of the secondary heat exchanger 8, the trap 102 of indirect brine type and the trap 103 of the U.S. Pat. No. 4,407,140, a brine pump 9 for use in the shelf and a brine pump 10 for use in the trap and the arrangement are wholly indicated by a thick line.

In FIG. 2 and FIG. 3, furthermore, 15 shows a sluice valve provided in the brine circulating system. In this connection, however, it should be noted that the piping line in each system, the valves and the machinery arrangement sequence in the pipe line are not actually as shown in drawings, in other words drawings are simplified by the way of the explanation within the U.S. Pat. No. 4,407,140.

FIG. 4 and FIG. 5 have shown each view roughly illustrating the vertical section (line A—A of FIG. 5) and the transverse section (line C—C of FIG. 4) of the trap chamber 2 and trap 103 of vacuum freeze dryer illustrated in FIG. 3. A thin broken line shown within a trap plate of FIG. 4 indicates a flow passage of refrigerant R (which corresponds to the refrigerant cooling coils denoted with the numeral 26 in FIG. 6). The rough broken line indicates a boundary of flow passage of brine within the plate (which corresponds to a partition wall denoted with the numeral 27 in FIG. 6), and FIG. 6 is a view illustrating one embodiment of the section of this plate.

One form of a condensing plate X of the trap 103 (vapor condenser) is shown in FIG. 4, and FIG. 7 illustrates another embodiment of a small-sized trap where the inner wall of the vacuum trap chamber is constituted into cylinder. In both situations, a refrigerant evaporation coil 26 is closely contacted with the trap (vapor condensing plate) 103 by welding, press, fitting and the like, and the condensing plate X of the trap 103 performs as heat transfer fin of refrigerant R. Heat exchanges between refrigerant R and brine B through a refrigerant coil wall and the trap 103 as a fin plate, between brine B and vapor V through the condensing plate X of the trap 103 as a brine wall, and between refrigerant R and vapor V through the condensing plate X of the trap 103 as a fin of refrigerant coil 26, respectively. Thus, heat exchange is effected between two mediums selected optionally from among three mediums, namely R, B and V through a boundary metal wall or fin plate. 28 is an outer wall of the vacuum trap chamber 2.

The trap in vacuum apparatus as shown in FIG. 1 to FIG. 3, which is a refrigerant evaporator of refrigeration unit, is usually arranged in the trap chamber. In FIG. 1, the trap with "refrigerant direct cooling type" is utilized. As shown in FIG. 2, brine being cooled by a cooler outside vacuum trap chamber by means of the heat exchanger 7 (hereinafter sometimes called the "cooler 7") of refrigerant evaporator 7*a* and a circulating circuit of medium fluid of the trap including a brine pump 10 is circulated through the trap 102 with "indirect brine type" in the vacuum trap chamber 2, and a "three medium heat exchange type" where both the refrigerant and the brine circulate inside thereof is utilized as shown in FIG. 3.

For the first form utilizing the trap 101 with "refrigerant direct cooling type", there are some drawbacks, such as, shortage of the operational stability, uneasiness of maintenance, and difficult in controlling the temperature of the vapor condenser, the necessaries of additional secondary refrigeration units and secondary heat exchangers. In the second form utilizing the trap 102 with "indirect brine type", although the said defects of the first form may be improved, some disadvantageous have been occurred in that the presence of the following two refrigeration capacity losses. The first loss is a temperature loss induced through the boundary film heat transfer occurred twice between the refrigerant coil surface and the brine and brine trap surface and brine duo to a indirect heat exchanging between the refrigerant and the condensing surface of the trap. And in external heat exchanger 7, in order to increase the heat exchange between the refrigerant evaporator 7*a* and the brine and enhance the convection heat transfer coefficient of the brine, and to circulate the brine having been cooled in the external heat exchanger 7 through the trap 102, a large capacity brine pump 10 is necessary for a small temperature difference between inlet and outlet of the trap 102, thus, the second refrigeration capacity loss is occurred. Moreover, because of the brine machinery arrangement including the large-sized heat exchanger 7 and the brine pump 10 and the sluice valve 15 arrangement in the pipeline out of the vacuum trap chamber 2, a large amount of input heat loss will be caused. A larger installation area and excessive energy consumption is called for.

The third form utilizing the trap 103 with "three medium's heat exchange type" is the invention developed before by the present applicant and explained in U.S. Pat. No. 4,407,140. As shown in FIG. 3, it has improved the defects of the trap 101 with refrigerant direct cooling type by means of the arrangement of a trap circulating brine circuit as that of the second form fore-mentioned. Moreover, the heat exchanger between the refrigerant evaporator and the brine is arranged within vacuum trap chamber 2. Thus the drawbacks of the trap with "indirect brine type" in the second form were improved by means of the trap 103 with "three medium heat exchange type" where the vapor is cooled from both sides of the refrigerant and the brine even independently of its companion medium. This form has already been popularized in the vacuum freeze drying apparatus for pharmaceutical products. Especially in Japan it is occupying a principle position instead of the usual two forms of the refrigerant direct cooling type and indirect brine type mentioned above.

Although the third form trap 103 in the prior invention is a heat exchanger between three mediums where also between two mediums selected optionally from among three mediums including the refrigerant, the brine and the vacuum vapor there exists a direct heat exchange through a boundary metal wall or a metal plate closely contacting therewith, a part of the refrigeration capacity necessary for condensing will have a heat exchange with the vacuum vapor on the condensing surface of trap 103 from the refrigerant cooling coils by direct expansion. And another part of cooling heat flux will transfer to the condensing surface of the trap by way of the circulated brine when condensing the vacuum vapor. Therefore, efficient for trap condensing vacuum vapor is depending on heat flux exchanging directly with vacuum vapor from the refrigerant and on heat flux exchanging with vacuum vapor by way of the circulated brine. And, the heat flux transferred by way of the circulated brine is closely related to the boundary film heat transfer coefficient of the brine.

However, the vapor trap plate X of the trap 103 in the prior invention has a too small contact surface between the refrigerant cooling coils 26 of refrigerant evaporator and the metal plate of the trap plate X. Thus, the heat flux exchanging with vacuum vapor V by direct expansion of the refrigerant R decreases, and a large quantity of the refrigeration heat flux exchanges with vacuum vapor V on the condensing surface of vapor trap plate X of trap 103 by way of the circulated brine B.

However, in recent years, silicon oil is being used as the circulating brine B especially in vacuum freeze drying apparatus for treating the material of pharmaceutical products to be dried. This brine B of silicon oil has a high viscosity at low temperature and the boundary film heat transfer coefficient is decreasing. Therefore, as shown in FIG. 8, the vapor trap plate X is constructed by fitting a holding bar 29 in the passage of brine B, installing each two pipes of the refrigerant cooling coils 26 in upper and lower space of bar. A shortage of heat exchange surface of the brine B in passage is improved by using total four pipes of the refrigerant cooling coils 26. However, heat transfer temperature difference loss has been on the increase because of twice boundary film heat transfers by way of the brine. And, accompanied with strengthen of regulation of Freons in refrigerator unites, the low-end evaporation temperature rises for two-stage compression refrigeration system. Because of less heat flux by direct cooling, a fall in boundary film heat transfer coefficient of the circulated brine B and limitation of alternative refrigerants, it is difficult to meet requirement for a lower temperature vapor condenser below −70° C. especially in vacuum freeze drying apparatus.

And, this trap 103 is using the circulating pump 9 as a driving force to circulate the brine in the heat transfer fluid circuit. In this means, necessary capacity of the circulating pump 9 is certainly smaller than in former means for using the trap 102 with indirect brine type, while there is also a refrigeration capacity loss by input heat. However, as for the trap 103 being manufactured according to the prior invention, because the section area of flow passage is too wide, it is necessary to increase the capacity of circulating pump for ensuring an essential boundary film heat transfer coefficient, especially for a brine of silicon oil. Therefore, effective refrigeration capacity of the refrigerant will be decreased and some disadvantageous factors will be caused for the condensing capacity of the trap and low-end trap temperature duo to input heat loss from the circulating pump.

SUMMARY OF THE INVENTION

In order to improve these drawbacks, heat transfer between three mediums has been theoretically calculated and a method been found out in which heat flux transferred by the refrigerant direct cooling with a small heat transfer temperature difference may be increased in the present invention. It is the object of the present invention to improve the low heat transfer efficient of direct contact between the refrigerant cooling coils and the plate wall of the trap in prior invention without difficulty in manufacture of the vapor condensing plat of trap. By increasing the contact surface between the refrigerant cooling coils and the metal plate, a higher heat transfer property and lower loss of heat transfer temperature difference between the refrigerant and the vacuum vapor on the condensing surface may be achieved. At the same time, a greater boundary film heat transfer coefficient of the circulated brine may be obtained so that vapor condenser with excellent heat transfer property and high efficient vapor condensing capability for use in vacuum apparatus will be provided.

Moreover, in the present invention, as means for achieving this goal, the refrigerant cooling coils, in which the refrigerant conducted from refrigerator unite is evaporated, are inserted through passage of the brine formed inside the vapor trap plate made from metal. A heat exchanger between a refrigerant evaporator and a heat transfer fluid is installed in a vacuum chamber or at inner wall where the outer surface of this heat exchanger, wholly or partially, faces a vacuum space. This heat exchanger is so constructed that the outer surface metal plates of the heat exchanger on the vacuum space side may be cooled, directly or through direct metal contact, even independently of its companion medium, from both sides of the refrigerant and the heat transfer fluid. And outer surface of heat exchanger on the vacuum space side is utilized for condensing and trapping the vacuum vapor. In this vapor condenser for use in vacuum apparatus, the refrigerant cooling coils inserted within the passage of brine in heat exchanger are so deformed into a shape of flat elliptical pipe that long axis of ellipse is parallel to the above mentioned condensing surface. A side or two sides of a pair of flat faces formed by deformation machining are closely contacted with the inner surface of wall in the passage of the brine, then are fitted within the passage mentioned above to increase the contact surface between the refrigerant cooling ellipse coils and inner wall of the passage of brine in the vapor trap plate, enhance boundary film convection heat transfer coefficient of the brine circulated in the passage of the said heat exchanger, and provide a high efficient vapor condenser characterized by excellent heat transfer property and great vapor condensing capability for use in vacuum apparatus.

As the means of the present invention, vacuum apparatus is a vacuum freeze drying apparatus for use in treating pharmaceutical products as the materials to be dried. The whole of constitution of the apparatus may be formed as same as the vacuum freeze dryer with a "three medium heat exchange type" trap shown in FIG. 3.

And, for the trap utilizing in the present invention, the vapor trap plate is constructed into a plate shape with the metal, the refrigerant cooling coils are inserted through the flow passage of the brine formed inside the plate. A heat exchanger between three mediums is constituted where also between two mediums selected optionally from among three mediums comprising the refrigerant, the brine and the vacuum vapor there exists a direct heat exchange through a boundary metal wall or a metal plate closely contacting therewith. It is the same way as the trap by former means in FIG. 3 mentioned above.

However, in the flow passage of the brine formed inside the vapor trap plate made from metal plate comprising main parts of this trap, the refrigerant coils arranged by inserting it along this flow passage are constructed into a around ellipse shape in the section. Size of long axis is 1.5 times of short axis. By means of making a press manufacture to the pipe with tube shape made from the metal along vertical direction of pipe wall, pushing and crushing it, a pair of wall surfaces faced each other will become flat surfaces crossing the axis line of flat pipe.

Moreover, the refrigerant cooling coils constructed into a shape of flat ellipse in the section are so fitted within flow passage of the brine formed inside the vapor trap plate that flat face of the elliptical cylinder is roughly parallel to vacuum vapor condensing surface of the vapor trap plate. And a side or two sides of this pair of flat faces are connected with inner wall of the passage and closely contacted by welding or press fitting.

At that time, flow passage of the brine formed inside the vapor trap plate may be constructed into such a size and formation narrowed the section area to corresponding the size of the coils pressed in comparison with the passage by the former means.

When four pipes of the refrigerant cooling coils are installed in flow passage with such a formation in which the refrigerant cooling coils are double fitted side by side in the direction of the width, as shown in FIG. 8, the contacting extent may increase with a holding bar. It is installed between upper and lower of passage wall. And, the holding bar is performing as attempt to escape the difference of coefficient of expansion between the plate and the coils. In addition, because section area of the passage may be 60–70% narrowed, the velocity of flow of brine circulated within this passage may increase and it is possible to use a circulating pump with small capacity.

The refrigerant cooling coils inserted through the passage, when using the cylindrical pipes with tube shape and pressing it, may be so formed that the shape of section becomes a flat ellipse formation. In other method, it may be constructed into a shape with flat ellipse in section by means of extrusion of the metal at first.

DESCRIPTION OF THE PREFERRED EMBODIMENTS

Next, the embodiments will be explained in details in accordance with views. Moreover, the view symbols will use the same ones for the constructed parts having same functions with former means.

Figure 9:
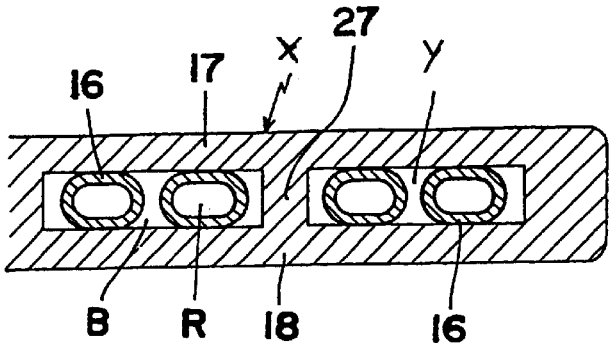
FIG. 9 is a vertical sectional view of the trap part of the apparatus of the present invention.

FIG. 9 has illustrated a vertical section view of a vapor trap plate constituting the part of a trap (vapor condenser) for use in vacuum apparatus according to the present invention. In this figure, X is represented as the vapor trap plate constructed into a plate shape with the metal, Y as a passage formed inside the plate X, B as a brine circulated in the passage Y. 16 is represented as refrigerant cooling ellipse coils inserted through the passage Y and installed, and R as a refrigerant circulated through the cooling ellipse coils 16.

Figure 1:
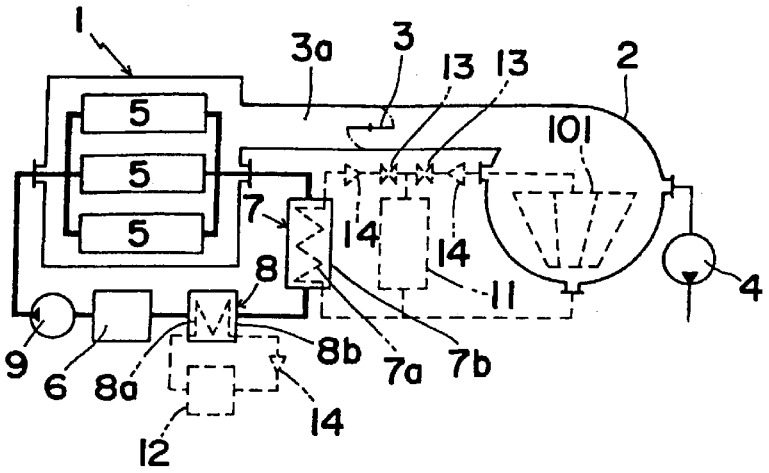
FIG. 1 (PRIOR ART)
FIG. 1 is a view roughly illustrating the conventional vacuum apparatus utilized a trap with refrigerant direct cooling type.
Figure 2:
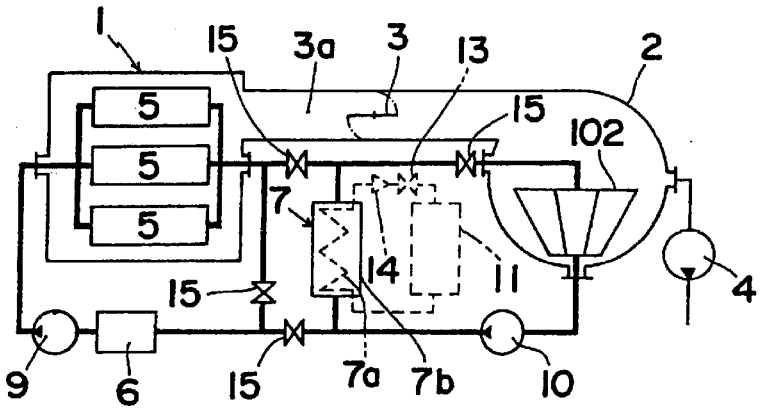
FIG. 2 (PRIOR ART)
FIG. 2 is a view roughly illustrating another conventional vacuum apparatus utilized a trap with indirect brine type.
Figure 3:
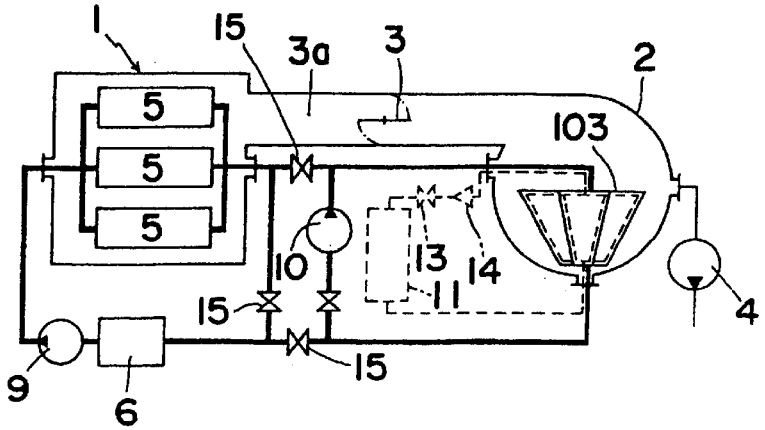
FIG. 3 (PRIOR ART)
FIG. 3 is a view roughly illustrating the vacuum apparatus of the prior invention (U.S. Pat. No. 4,407,140) used a trap with three medium heat exchanger type.
Figure 4:
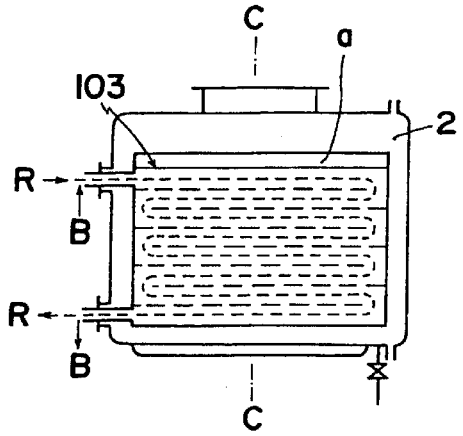
FIG. 4 (PRIOR ART)
FIG. 4 is a vertical sectional front view of the trap chamber and the trap of the apparatus according to the prior invention.
Figure 5:
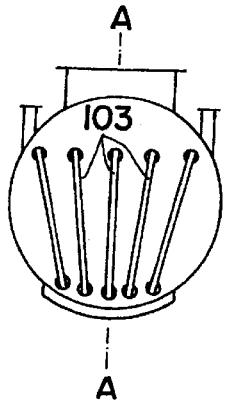
FIG. 5 (PRIOR ART)
FIG. 5 is a vertical sectional side view of the trap chamber and the trap of the apparatus according to the prior invention.

The vacuum apparatus in this embodiment is a vacuum freeze drying apparatus mainly used for drying treatment of pharmaceutical products as shown in FIG. 3. The trap assembled in this apparatus is a "three medium heat exchange type" represented with "103" in FIG. 3 and elementary constitutions of the vacuum apparatus and the trap have no change with the former method explained in FIG. 3 to FIG. 7.

Figure 6:
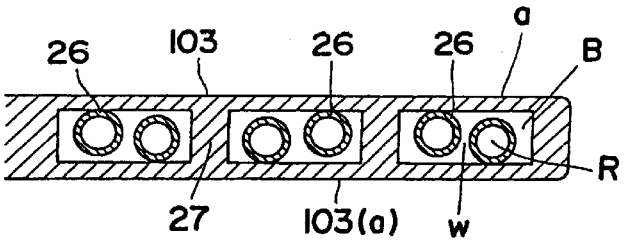
FIG. 6 (PRIOR ART)
FIG. 6 is a vertical sectional view of the trap part of the apparatus of the prior invention.
Figure 7:
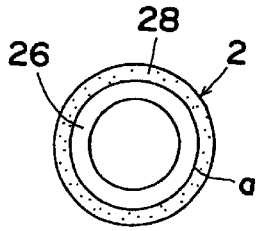
FIG. 7 (PRIOR ART)
FIG. 7 is a vertical sectional view illustrating different embodiments of the trap chamber of the prior invention.

However the passage Y of the brine B formed inside the vapor trap plate X may be narrowed around 60~70% with comparison to the prior invention where two pipes of the refrigerant cooling coils 26 with cylindrical pipe were inserted through passage and installed as shown in FIG. 6.

The refrigerant cooling ellipse coils 16 inserted through the passage Y and installed, by means of pressing the refrigerant cooling coils 26 made with former means, are constructed into a shape of flat ellipse in the section with the short axis being around ⅗ of the long axis.

Figure 10:
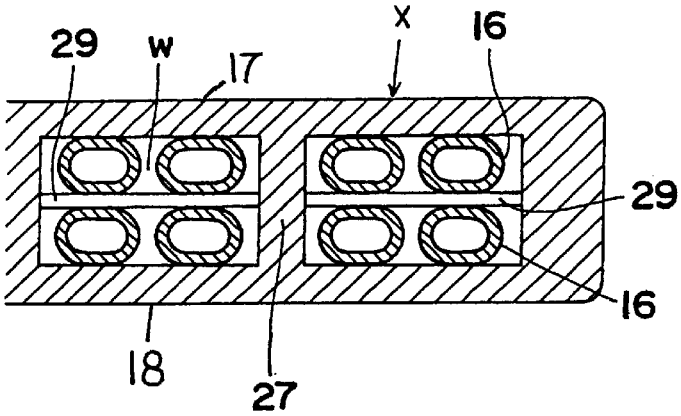
FIG. 10 is a vertical sectional view of another form of trap part of the apparatus according to the present invention.

FIG. 10 shows another embodiment. In this embodiment, the holding bars 29 are installed within the passage Y, each two pipes of the refrigerant elliptical coils 16 instead through upper side and lower side of the bar. The passage Y is constituted with a rough ⅗ high (size in direction of the thickness of the vapor trap plate X) of the former means.

And, as for the refrigerant cooling ellipse coils 16 inserted through the divisions of these passages Y, one side of flat face 16*a* is closely contacted with the top of wall 17 of the passage Y when inserted through the upper division. Then another side of the flat face 16*a* is contacted with the bottom of wall 18 of the passage Y when inserted through the lower division.

Figure 11:
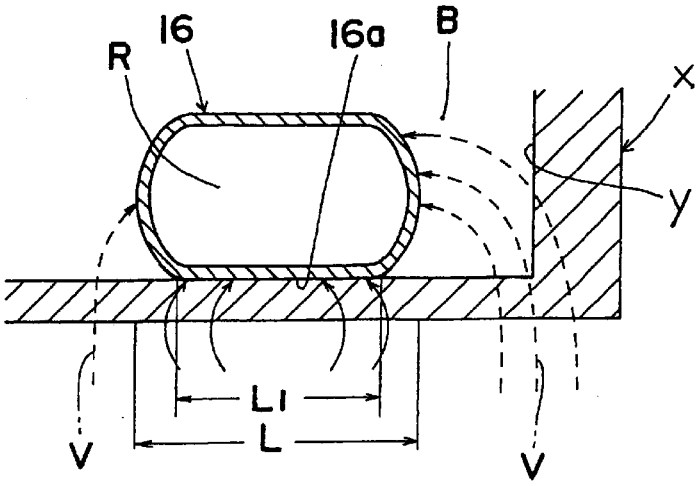
FIG. 11 is a view illustrating the heat flux when vapor condenses on the trap of the apparatus according to the present invention.

FIG. 11 is a view illustrating roughly the heat flux when vapor condense on the vapor trap plate X mentioned above. For the heat flux Q transferring horizontally through the plate with a width L from the vapor condensing surface (surface of the ice layer) of the plate X, heat flux Q1 is transferring to refrigerant cooling coils by direct heat conduction (by way of contact heat resistance) with a width L1, the heat flux Q2 to the refrigerant cooling ellipse coils 16 from the vapor trap plate X and by way of the boundary film heat transfer of the brine B circulated in the passage Y with a width L-L1, the width of contact surface between the refrigerant cooling coils 16 and the vapor trap plate X is $\epsilon$.

On one hand, the heat flux Q1 transferring to refrigerant cooling ellipse coils 16 by direct heat conduction depends on the following heat resistance. That heat resistance R13 through trapped ice layer, heat resistance R12 through the thickness of metal plate of vapor condenser plate X to the contact surface $\epsilon$, and heat resistance R11 of the contacting surface. In all resistance, heat resistance R11 of the contacting surface is strongly affected by the contacting surface $\epsilon$ between refrigerant evaporating coil and vapor condenser plate X and the equivalent contact clearance $\delta$.

For the vapor condenser (trap) by means of the present invention, the contact surface $\epsilon$ is largely increased by using flat elliptical pipe for refrigerant cooling coils instead of cylindrical pipe, thus, decreases the contact heat resistance and increases the heat flux Q1 transferred to refrigerant cooling coils by direct conduction.

On the other hand, the heat flux Q2 transfers to refrigerant cooling ellipse coils 16 by way of the circulated brine B. The resistance includes heat resistance R24 through trapped ice layer, heat resistance R23 through the thickness of metal plate, boundary film heat transfer resistance R22 between the inner surface of trap plate (including partition wall) and the brine, and boundary film heat transfer resistance R21 between the surface of refrigerant cooling ellipse coils 16 (excepting the contact surface$\epsilon$) and the brine. In all resistance, heat resistance R22 and R21 are greatly affected by heat transfer coefficient of boundary film of the circulated brine. Enhancement of heat transfer coefficient of boundary film may increase the heat flux by way of the circulated brine B. The theoretical calculations of heat transfer efficiency for the condenser plate X have shown that the trap of the present invention may decrease the contact heat resistance because contact surface $\epsilon$ between the coil and the metal plate of the trap plate X is largely increased by using elliptical pipes as refrigerant cooling coils 16, a greater heat transfer coefficient from the refrigerant in the ellipse coil 16 to the surface of ice layer on the trap has been obtained in the present invention than in the former one, and heat transfer efficiency may be increased around 22% during the initial stage of freeze drying, 13% even if during the media of drying.

In the present invention, the plate trap is manufactured by refrigerant cooling coils of elliptical pipes. Thereafter, inner passage Y of the trap plate X may be thinly formed as shown in FIG. 10, thus decreasing the flow section of the brine and enhancing flow of the brine, and increasing heat transfer coefficient of boundary film. If using a brine pump with same capacity as the trap of the former invention, the velocity of flow of the brine increases and heat transfer coefficient of boundary film is able to increase about 50%. When obtaining a same heat transfer coefficient of boundary film as the trap of the former invention, a 60% circulating volume of the brine of the present apparatus is sufficient. Therefore, the pump capacity of the brine may be decreased in half and the input heat loss to be caused by the pump will be decreased, too.

Figure 8:
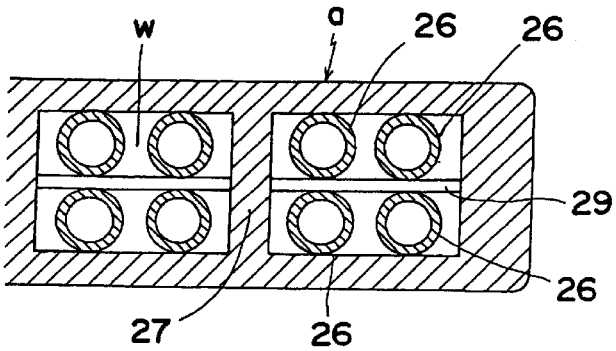
FIG. 8 (PRIOR ART)
FIG. 8 is a vertical sectional view of another different form of trap part of the apparatus according to the prior invention.

And, as another embodiment of the present invention illustrated in FIG. 10, in order to increase the heat transfer area, elliptical pipes of the refrigerant cooling coil 16 are twice put into the trap plate. In comparison with the plate trap using four pipes as the refrigerant cooling coil 26 illustrated in FIG. 8, the trap plate X may be thinly manufactured so that the section of flow of the brine will be narrowed and a larger velocity of flow of the brine will be gained.

As explained above, the refrigerant cooling coils inserted through the passage in vapor trap plate have been made a change from cylindrical pipe into elliptical pipe and this flat face is closely contacted with inner wall of the passage. Thus, the contact surface between the refrigerant cooling ellipse coil and the metal plate of vapor condenser plate is fully increased and the contact heat resistance may be greatly decreased according to the present invention. And the refrigerant cooling coils of elliptical pipe are manufactured by making coils of cylindrical pipe and then pressing it, the coils of elliptical pipe with most suitable long and short axes may be simply obtained, and the section area is almost same as circle. Therefore manufacture of the trap plate becomes ease.

When the section area of the refrigerant cooling coil of elliptical pipe is equal to that of circle pipe, the short axis of ellipse being less than diameter of circle. So, the plate of vapor trap may be thinly formed, the flow section of the brine is narrowed, and flow of the brine may be enhanced. And direct contact heat conduction of the refrigerant cooling coils and heat transfer coefficient of boundary film of the circulated brine may be improved simultaneously. Thus, it is possible to gain a vapor condenser with a better heat transfer performance and higher efficient condensing capability for use in vacuum apparatus according to the present invention.

What is claimed is:

1. A vapor condenser with high efficiency for use in a vacuum apparatus, comprising in combination:

a heat-exchanger having tubes for evaporation of refrigerant to be introduced from a refrigerator unit, each of said tubes being inserted into and through passageways for a liquid heat medium in a vapor trap plate made of a metal material to carry out heat exchange between a cooling medium in the tubes and the heat medium, said heat-exchanger being installed within a vacuum chamber with an outer surface of said heat-exchanger at a side of a vacuum space of said heat-exchanger facing said vacuum space, the outer surface of said heat-exchanger at the side of said vacuum space being cooled by contact from either side of said cooling medium and said liquid heat medium, said outer surface of said heat-exchanger at the side of the vacuum space serving a dual function as a surface for condensing and collecting the vacuum vapor;

wherein said tubes for said cooling medium have a flat elliptical shape, a major axis of the elliptical shaped tubes being parallel to said surface for condensing and collecting vacuum vapor;

wherein the flat elliptical shaped tubes are inserted into said passageways in close contact with an inner wall surface of the passageway for the liquid heating medium to effect reduction in the cross-sectional area of the passageway for said liquid heating medium and reduction in thickness of said vapor trap plate, as well, to increase contact area between the elliptical shaped tubes and the inner wall surface of the passageway for the liquid heating medium in said vapor trapping plate and to accelerate heat-transfer of said liquid heat medium in said passageway of the heat-exchanger through convection at the film boundary so as to obtain enhanced heat-transfer capability as well as condensing capability of the vapor under vacuum.

2. The vapor condenser according to claim 1, wherein the flat elliptical tubes each have a cross-sectional area equal to that of a circular cylindrical tube for evaporating cooling medium and a minor axis shorter than a diameter of the circular cylindrical tube.

* * * * *